US010674800B1

(12) United States Patent
Son

(10) Patent No.: US 10,674,800 B1
(45) Date of Patent: Jun. 9, 2020

(54) EQUIPMENT FOR SWITCHING SUITCASE INTO BACKPACK

(71) Applicant: Kwangwon Son, Changwon-si (KR)

(72) Inventor: Kwangwon Son, Changwon-si (KR)

( * ) Notice: Subject to any disclaimer, the term of this patent is extended or adjusted under 35 U.S.C. 154(b) by 0 days.

(21) Appl. No.: 16/359,008

(22) Filed: Mar. 20, 2019

(51) Int. Cl.

| | |
|---|---|
| ***A45C 13/30*** | (2006.01) |
| ***A45C 5/03*** | (2006.01) |
| ***A45C 13/10*** | (2006.01) |
| ***A45F 4/02*** | (2006.01) |
| ***A45C 9/00*** | (2006.01) |

(52) U.S. Cl.
CPC ..... *A45C 13/30* (2013.01); *A45C 5/03* (2013.01); *A45C 9/00* (2013.01); *A45C 13/1092* (2013.01); *A45F 4/02* (2013.01)

(58) Field of Classification Search
CPC ..... A45C 13/30; A45C 13/1092; A45C 5/03; A45C 9/00; A45F 4/02
See application file for complete search history.

(56) References Cited

U.S. PATENT DOCUMENTS 1,696,191 A * 12/1928 Coulson ..... A45F 3/10 224/627
4,082,208 A * 4/1978 Lane, Jr. ..... A45F 3/04 220/4.27
5,810,223 A * 9/1998 Helm ..... A45F 3/14 224/250
5,918,785 A * 7/1999 Irose ..... A45F 3/14 224/250
6,164,505 A * 12/2000 Holter ..... A45C 13/38 224/259
D531,807 S * 11/2006 Koenig ..... D3/327
2010/0282790 A1* 11/2010 Peters ..... A45C 13/30 224/153

FOREIGN PATENT DOCUMENTS

KR 10-2016-0085130 A 7/2016

* cited by examiner

*Primary Examiner* — Corey N Skurdal
(74) *Attorney, Agent, or Firm* — Novick, Kim & Lee, PLLC; Jae Youn Kim

(57) ABSTRACT

Provided is equipment for switching a suitcase into a backpack in which a strap is attached to the suitcase and a shoulder strap is attached to the strap, thus allowing the suitcase to be carried over the shoulders when moving on stairs, an uneven road or the like and consequently having convenience and safety when carried. The equipment includes a longitudinal strap wrapped around a longitudinal circumference of a central portion on an exterior of the suitcase; a transverse strap wrapped around a transverse circumference of a lower portion on the exterior of the suitcase to cross the longitudinal strap at a front surface and a rear surface of the suitcase; and a pair of shoulder straps detachably connected to the longitudinal strap and the transverse strap to allow the suitcase to be carried over a user's both shoulders.

3 Claims, 13 Drawing Sheets

EQUIPMENT FOR SWITCHING SUITCASE INTO BACKPACK

BACKGROUND OF THE INVENTION

Field of the Invention

The present invention relates to equipment for switching a suitcase into a backpack, and more particularly, to equipment for switching a suitcase into a backpack, in which a strap is attached to the suitcase and a shoulder strap is attached to the strap, thus allowing the suitcase to be carried over the shoulders when moving on stairs, an uneven road or the like and consequently having convenience and safety when carried.

Description of the Related Art

Generally, a suitcase is a travel bag that is used to store and carry various items, such as clothes or shoes. The suitcase may store a lot of luggage including bulky items, and may keep the items in separate compartments depending on the type or use.

Since the suitcase is bulky and heavy, it is provided with a slidable handle and wheels. Thus, the suitcase is usually carried by pulling the handle out and then holding it with the hand.

However, because there are many places having no escalator or elevator in a travel destination, it is difficult to go up and down the stairs or move on a slope or an uneven terrain, such as a stone way or an unpaved road, it is not easy to carry the suitcase while holding it with the handle, and a walking posture is uncomfortable and the wrist or the shoulder may be strained if a user continues to roll the heavy suitcase.

As the related art, there has been proposed patent document 1 entitled a carrier backpack. This carrier backpack includes a box-shaped main body having a space to accommodate luggage therein, an LCD provided on an upper side of the main body to display the weight of the luggage, a detachable strap required when the carrier backpack is used as the backpack, a weight measurement sensor provided on a lower side of the main body to measure the weight of the luggage, wheels retractably provided to facilitate transport when the carrier backpack is used as the carrier, a separation rod, and a handle.

However, the related art does not describe a method of attaching and detaching the strap to and from the carrier. This is problematic in that it is inconvenient to use and the separation rod should be separated to switch from the carrier to the backpack, thus causing inconvenience to a user.

RELATED ART DOCUMENT

Patent Document (Patent Document 1) KR 10-2016-0085130 (Jul. 15, 2016)

SUMMARY OF THE INVENTION

Accordingly, the present invention has been made keeping in mind the above problems occurring in the related art, and an aspect of the present invention is directed to equipment for switching a suitcase into a backpack, in which a strap is attached to the suitcase and a shoulder strap is attached to the strap, thus allowing the suitcase to be carried over the shoulders when moving on stairs, an uneven road or the like and thereby affording convenience and safety when carried, an universal use is allowed, horizontal balance is maintained on both the shoulders when the suitcase is carried over the shoulders, and a safety strap is provided to ensure the safe transport of the suitcase.

Another aspect of the present invention is directed to equipment for switching a suitcase into a backpack, in which it is possible to conveniently pull out a slidable handle without the necessity of removing a strap, a rotational moment is reduced, thus preventing the suitcase from shaking or leaning to one side when the suitcase is carried over the shoulders, the strap is not dislodged while the suitcase is carried over the shoulders, the suitcase is easily carried over the shoulders and pressure on the shoulders or the abdominal region is reduced when the suitcase is carried over the shoulders.

In order to accomplish the objects, the present invention provides equipment for switching a suitcase into a backpack, including a longitudinal strap wrapped around a longitudinal circumference of a central portion on an exterior of the suitcase; a transverse strap wrapped around a transverse circumference of a lower portion on the exterior of the suitcase to cross the longitudinal strap at a front surface and a rear surface of the suitcase; and a pair of shoulder straps detachably connected to the longitudinal strap and the transverse strap to allow the suitcase to be carried over a user's both shoulders, an upper portion of each shoulder strap being connected to an upper portion of the longitudinal strap, a lower portion of the shoulder strap being connected to both sides of the transverse strap.

The present invention is advantageous in that the strap is attached to the suitcase and the shoulder strap is attached to the strap, thus allowing the suitcase to be carried over the shoulders when moving on the stairs, the uneven road or the like and thereby affording convenience and safety when carried, the universal use is allowed, the horizontal balance is maintained on both the shoulders when the suitcase is carried over the shoulders, and the safety strap is provided to ensure the safe transport of the suitcase.

Further, the present invention is advantageous in that it is possible to conveniently pull out the slidable handle without the necessity of removing the strap, the rotational moment is reduced, thus preventing the suitcase from shaking or leaning to one side when the suitcase is carried over the shoulders, the strap is not dislodged while the suitcase is carried over the shoulders, the suitcase is easily carried over the shoulders and pressure on the shoulders or the abdominal region is reduced when the suitcase is carried over the shoulders.

BRIEF DESCRIPTION OF THE DRAWINGS

The above and other aspects, features and advantages of certain exemplary embodiments of the present invention will be more apparent from the following description taken in conjunction with the accompanying drawings, in which.

DETAILED DESCRIPTION OF EXEMPLARY EMBODIMENTS

Figure 1A:
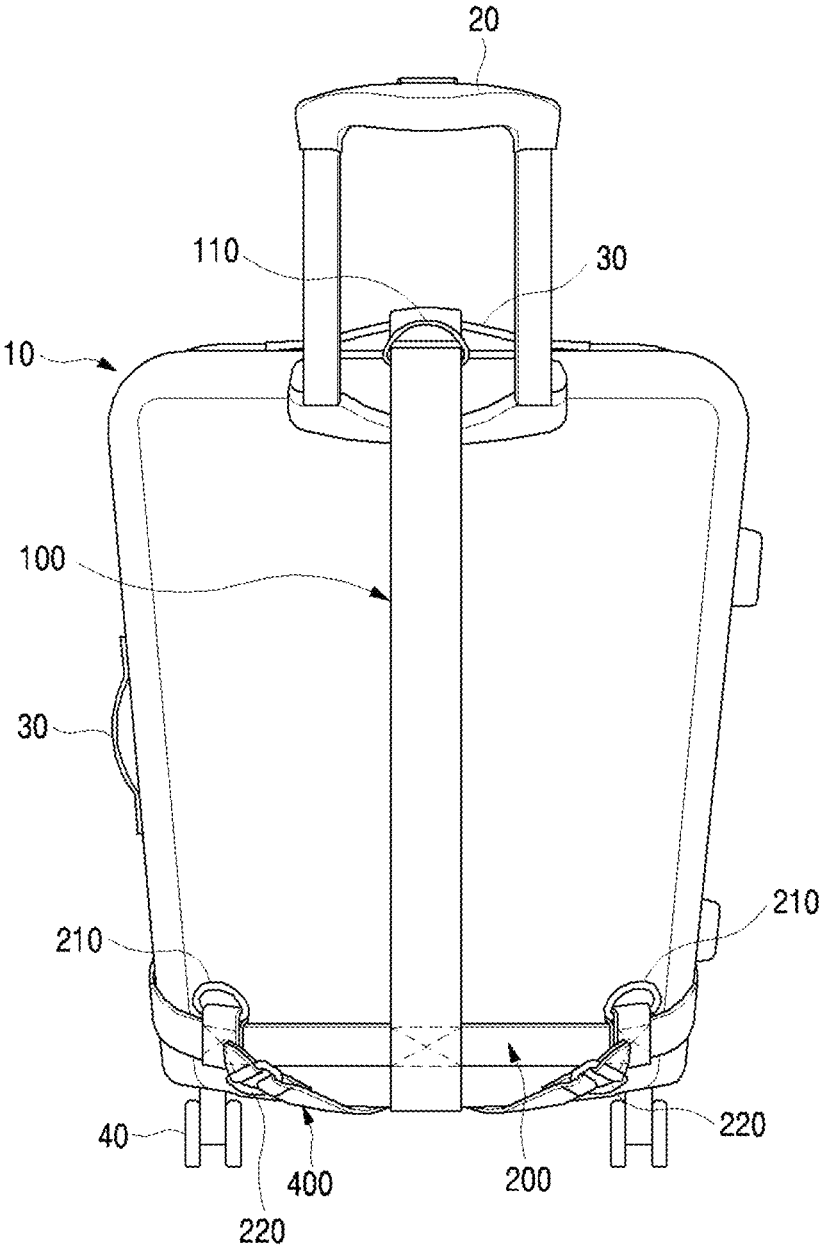
FIG. 1A is a view illustrating a front surface of a suitcase equipped with a longitudinal strap and a transverse strap according to an embodiment of the present invention.

Hereinafter, equipment for switching a suitcase into a backpack according to exemplary embodiments of the present invention will be described in detail with reference to the accompanying drawings.

In addition, the invention will be described with reference to a state where equipment is provided on a suitcase 10. When the suitcase 10 is carried over a user's shoulders to be switched into a backpack, a surface of the suitcase 10 coming into contact with his or her back will be defined as a front surface and an opposite surface thereof will be defined as a rear surface.

The equipment for switching the suitcase into the backpack according to the present invention attaches a strap to the suitcase and attaches shoulder straps to the strap, so that the suitcase is carried over the shoulders when moving on stairs, an uneven road or the like, thus having convenience and safety when carried. The equipment includes all or some of a longitudinal strap 100, a transverse strap 200, shoulder straps 300, a support strap 400 and a safety strap 500.

Generally, the suitcase 10 has on an upper portion of the front surface thereof a slidable handle 20 that is slidably pulled out and is used when rolling the suitcase 10. Fixed handles 30 are provided on an upper surface and a side surface of the suitcase, respectively, and are used to pick up and carry the suitcase 10. At this time, the fixed handle 30 provided on the upper surface is situated at a location that is slightly closer to a front side. Wheels 40 may be provided on a lower surface of the suitcase to roll on the ground.

Figure 1B:
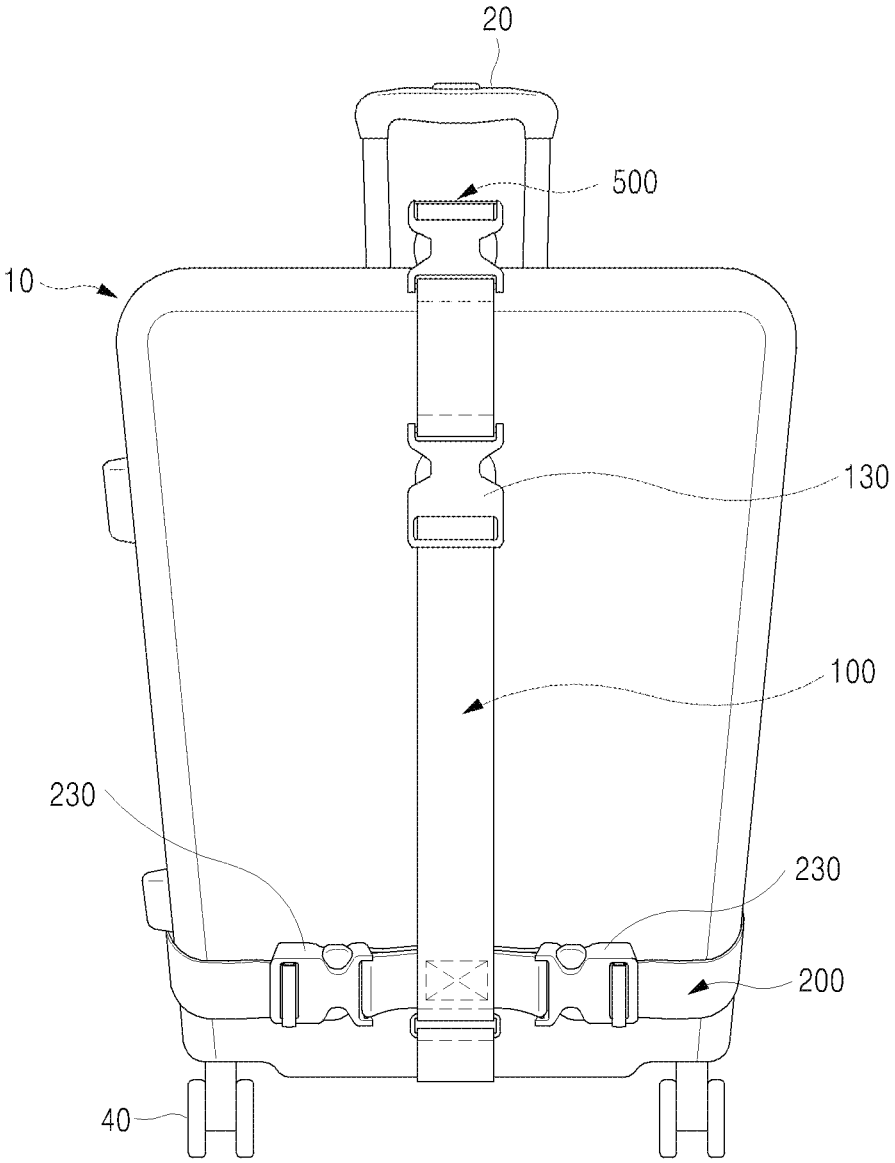
FIG. 1B is a view illustrating a rear surface of the suitcase equipped with the longitudinal strap and the transverse strap according to the embodiment of the present invention.

Referring to FIGS. 1A and 1B, the longitudinal strap 100 is wrapped around a longitudinal circumference of the central portion on the exterior of the suitcase 10, while the transverse strap 200 is wrapped around a transverse circumference of the lower portion on the exterior of the suitcase 10. The longitudinal strap 100 and the transverse strap 200 cross each other at the front surface and the rear surface of the suitcase 10. Since one longitudinal strap 100 passes through the inside of the slidable handle 20 and the fixed handle 30, the longitudinal strap obstructs the use of the slidable handle 20 and the fixed handle 30.

A conventional strap passes through the inside of the fixed handle 30 provided at a middle position on the side surface of the suitcase 10 to wrap around the suitcase 10, thus identifying the suitcase and preventing the suitcase from being unexpectedly opened or broken.

However, according to the present invention, such a strap is composed of the longitudinal strap 100 and the transverse strap 200 that cross each other to be attached to the suitcase 10. A pair of shoulder straps 300 may be detachably connected via the longitudinal strap 100 and the transverse strap 200, thus allowing the suitcase to be switched into the backpack by carrying the suitcase 10 over a user's shoulders when moving on the stairs, the uneven road or the like, and affording convenience and safety when carried, in addition to the effect of the conventional strap.

Figure 3:
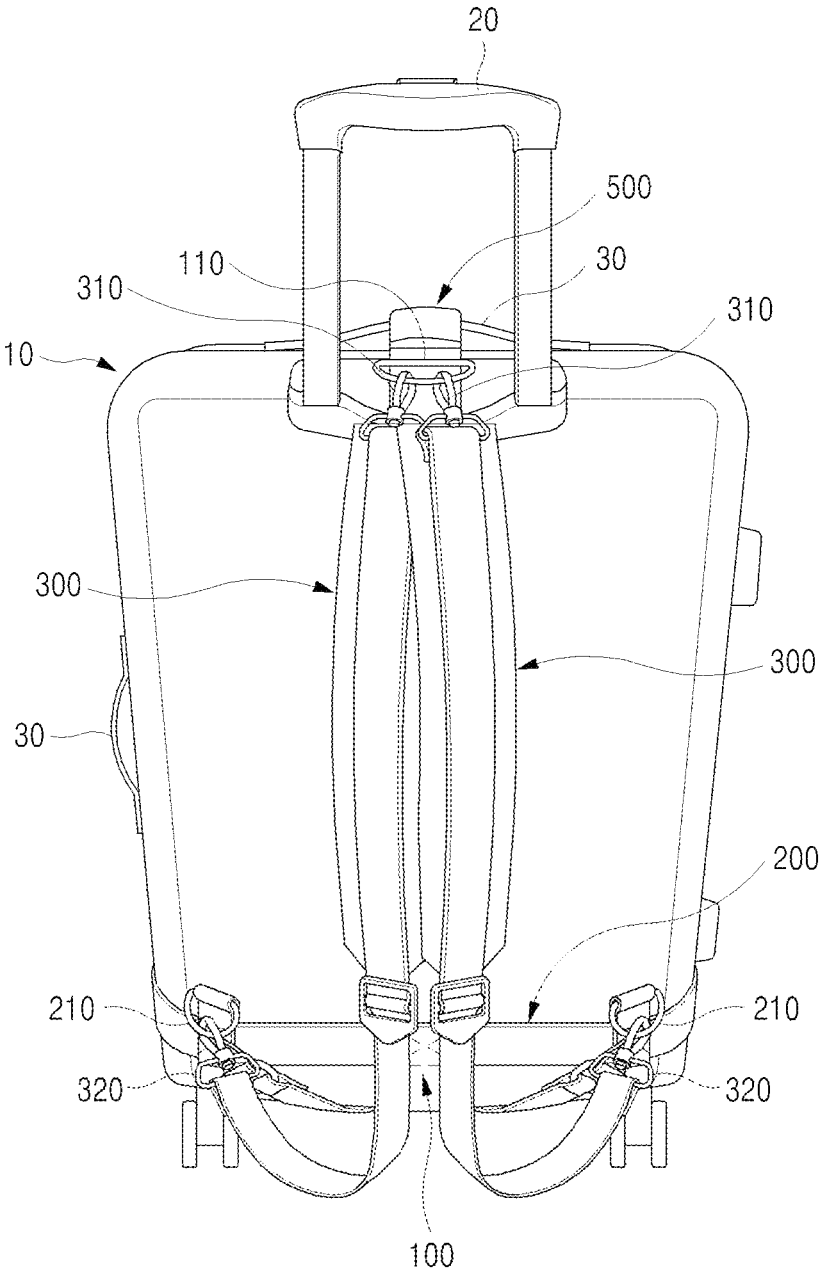
FIG. 3 is a view illustrating the suitcase with shoulder straps attached to the longitudinal strap and the transverse strap, according to the embodiment of the present invention.

Moreover, the longitudinal strap 100 has an upper ring 110 formed at an upper position on the front surface of the suitcase 10, and the transverse strap 200 has lower rings 210 formed at both sides on the front surface of the suitcase 10. Referring to FIG. 3, the shoulder straps 300 are detachably connected at upper portions thereof to the upper ring 110 via upper loops 310, and are detachably connected at lower portions thereof to both the lower rings 210 via lower loops 320. If the suitcase 10 is carried over both the shoulders using the shoulder straps 300, the shoulder straps 300 form a "∧" shape. Since this has universality, the suitcase may be used regardless of a user's body size.

Figure 2:
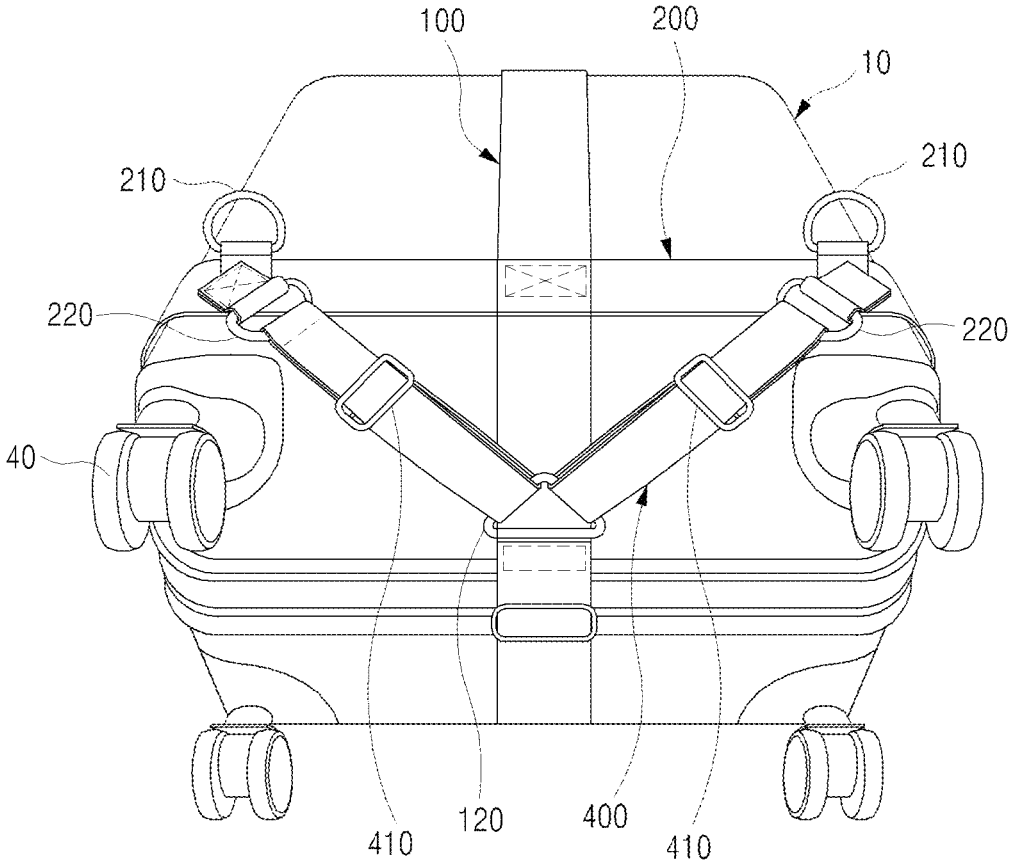
FIG. 2 is a view illustrating a bottom of the suitcase equipped with a support strap according to the embodiment of the present invention.

Furthermore, the longitudinal strap 100 has a triangular ring 120 formed on a lower surface of the suitcase 10, and the transverse strap 200 has support rings 220 formed diagonally at both sides on the front surface. Referring to FIG. 2, one end of each support strap 400 is connected to the triangular ring 120, while the other end of the support strap 400 is connected to the corresponding support ring 220, so that the support straps are attached in a "V" shape. As such, when the suitcase 10 is carried over the shoulders using the shoulder straps 300, the support straps 400 support both sides of the transverse strap 200, thus preventing the transverse strap 200 attached to the lower portion of the suitcase 10 from being moved upwards, and maintaining horizontal balance at both sides. Therefore, a user may move the suitcase 10 more comfortably and stably by carrying the suitcase over the shoulders like the backpack. The support strap 400 has at a middle position thereof a length adjusting member 410 to adjust the length of the support strap 400 depending on the size of the suitcase and thereby increase a support force.

The longitudinal strap 100 attached to the rear surface of the suitcase 10 has at a middle position thereof a longitudinal connection buckle 130, so that the longitudinal strap is detachably attached to the suitcase 10. The transverse strap 200 attached to the rear surface of the suitcase 10 is detachably connected to both sides of the longitudinal strap 100 via transverse connection buckles 230. As such, the longitudinal connection buckle 130 and the transverse connection buckles 230 are provided on a side opposite to a side to which the shoulder straps 300 are attached, thus making it convenient to carry the suitcase 10 over the shoulders, and allowing the longitudinal strap 100 and the transverse strap 200 to be rapidly and easily attached or detached.

The safety strap 500 is used to connect the fixed handle 30 formed on the upper surface of the suitcase 10 with the upper portion of the longitudinal strap 100. When the suitcase 10 is carried over the shoulders to be used as the backpack, the safety strap bears the load of the suitcase 10 in conjunction with the fixed handle 30, thus preventing the longitudinal strap 100 from being moved rearwards and enabling safe transport.

Figure 4A:
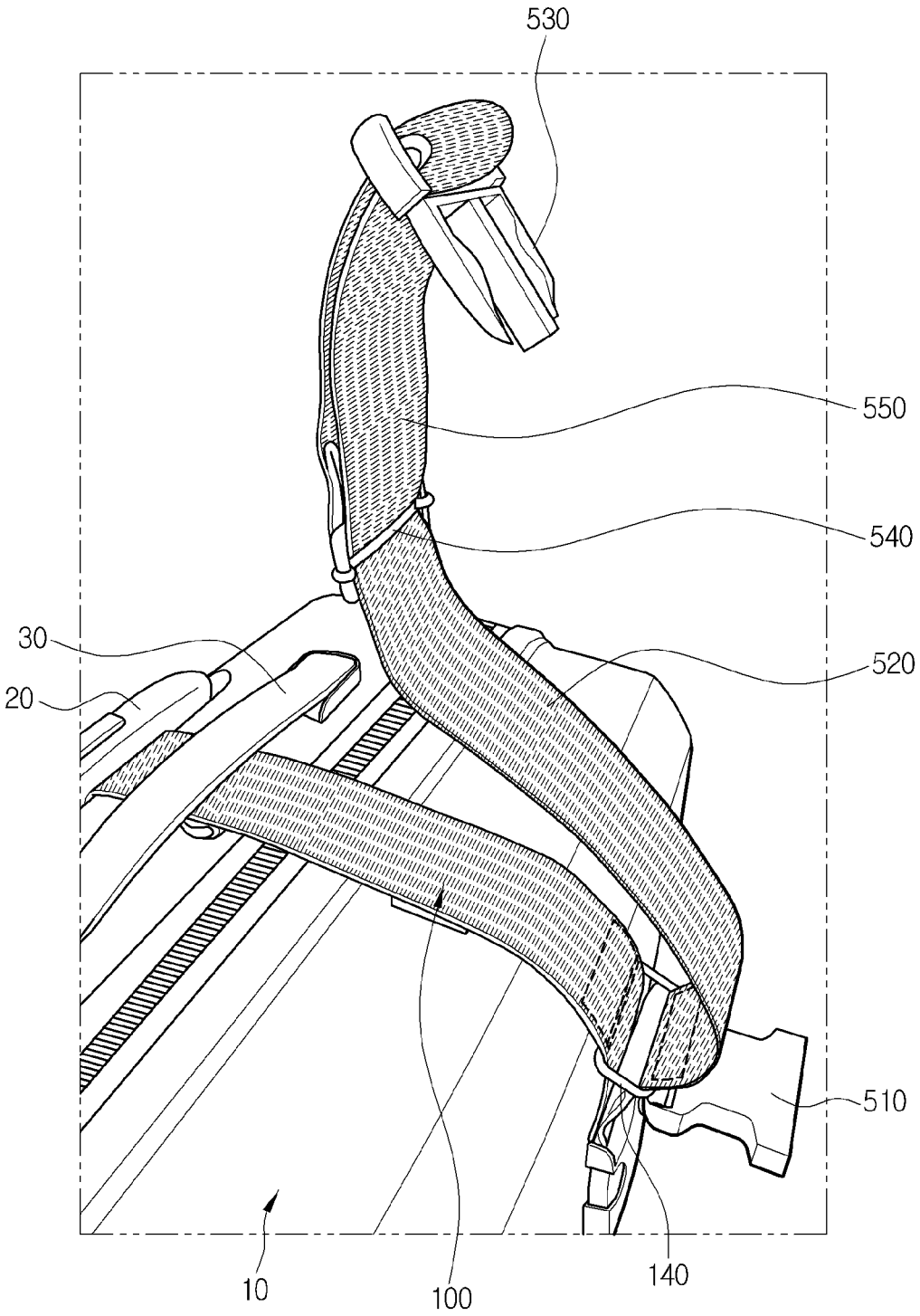
FIGS. 4A to 4F are views illustrating the configuration of a safety strap according to the embodiment of the present invention.
Figure 4B:
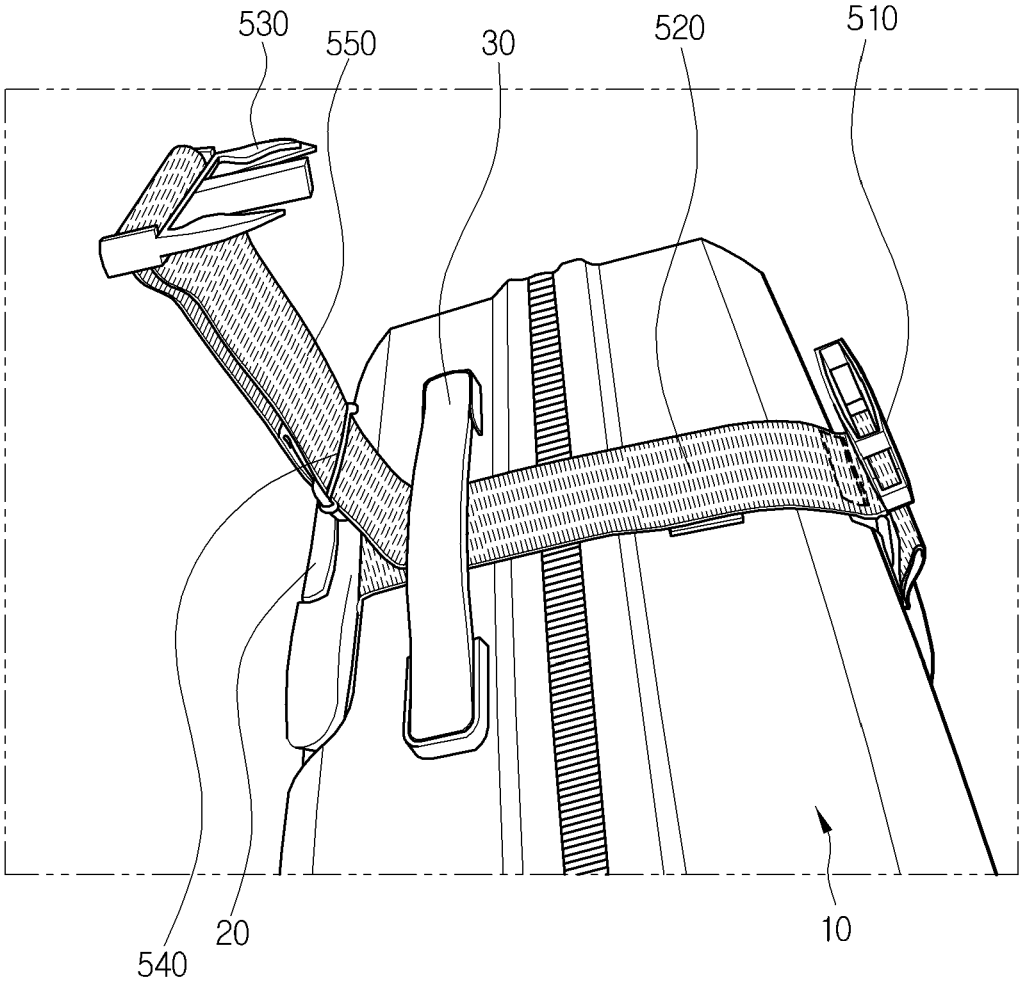
Figure 4C:
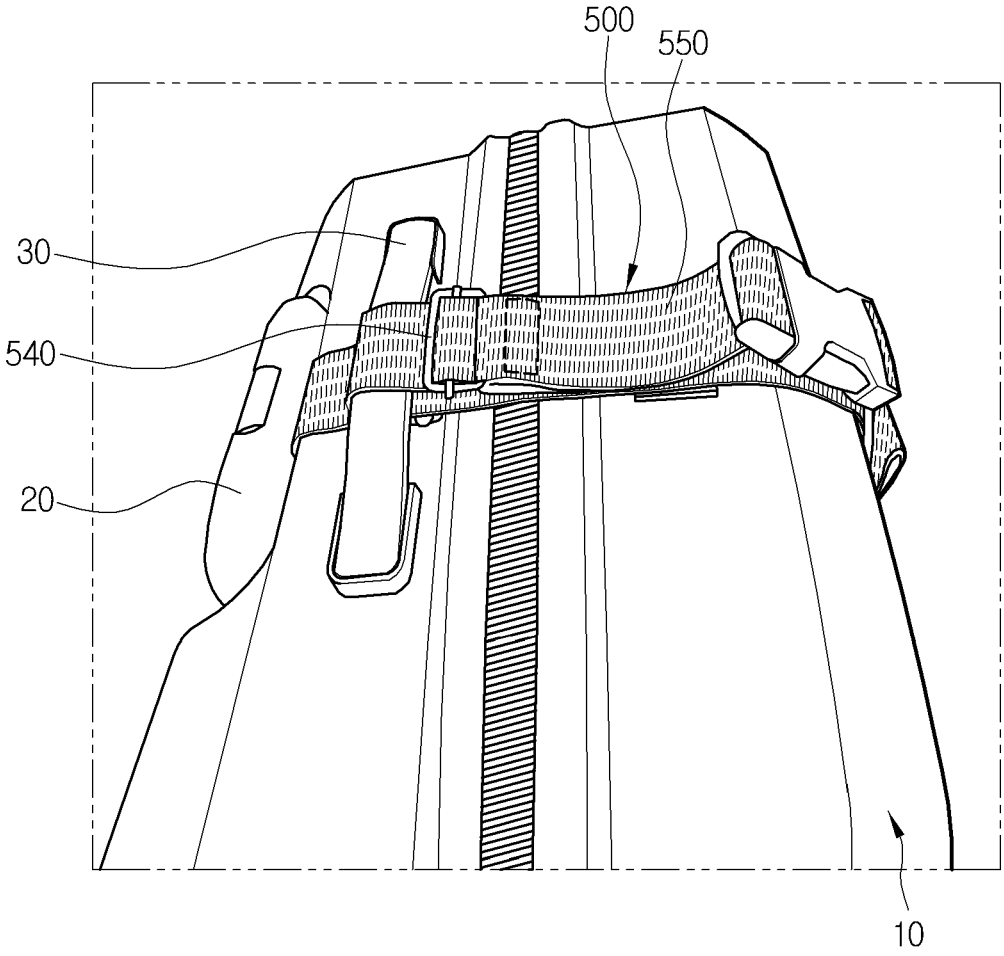
Figure 4D:
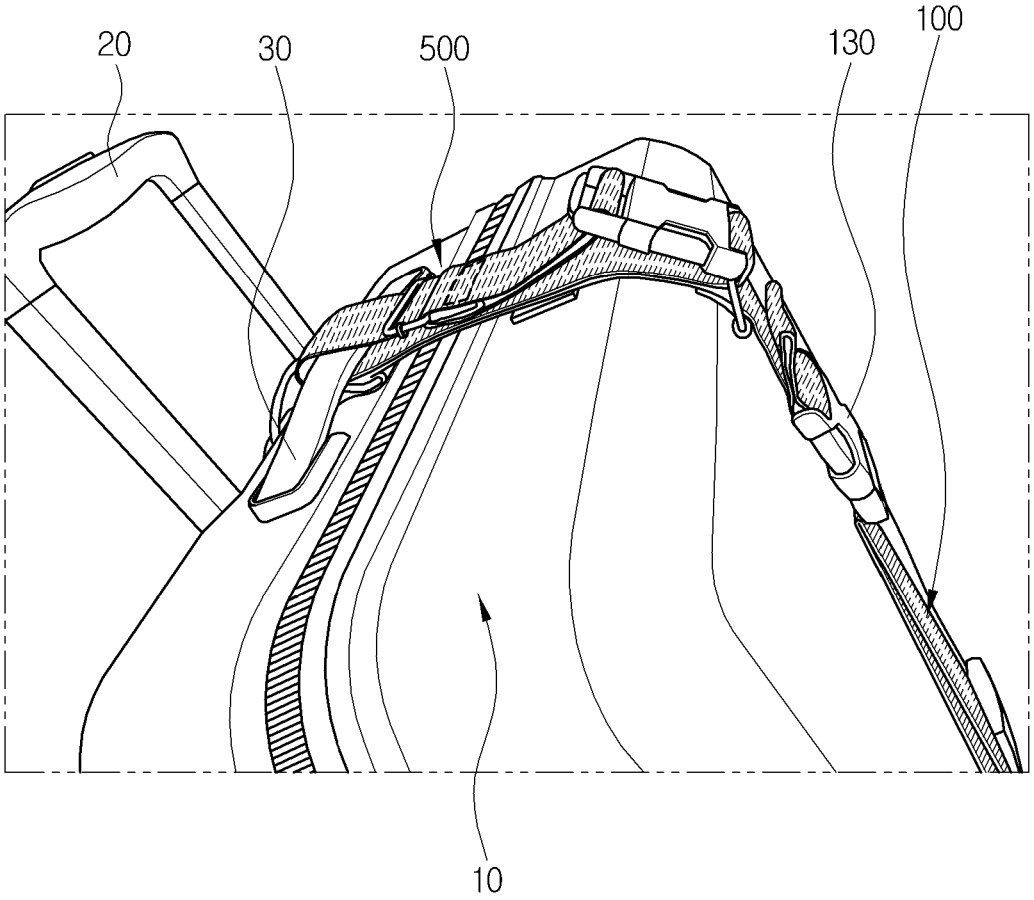

To this end, referring to FIG. 4A, the safety strap 500 is provided with an female buckle 510 to be connected to a rectangular ring 140 that is formed on the upper portion of the longitudinal strap 100. A safety belt 520 connects the rectangular ring 140 and a male buckle 530. As shown in FIG. 4B, the safety belt 520 is installed to extend forwards from the rectangular ring 140, pass through the inside of the fixed handle 30 on the upper surface of the suitcase 10 and then extend rearwards, so that an end of the safety belt 520 passes through the male buckle 530 to be connected thereto. When the suitcase 10 is switched into the backpack as shown in FIG. 4D by fastening the male buckle 530 to the female buckle 510 as shown in FIG. 4C, it is possible to bear the load of the suitcase 10 using the fixed handle 30 and to prevent the longitudinal strap 100 from being moved rearwards.

Figure 4E:
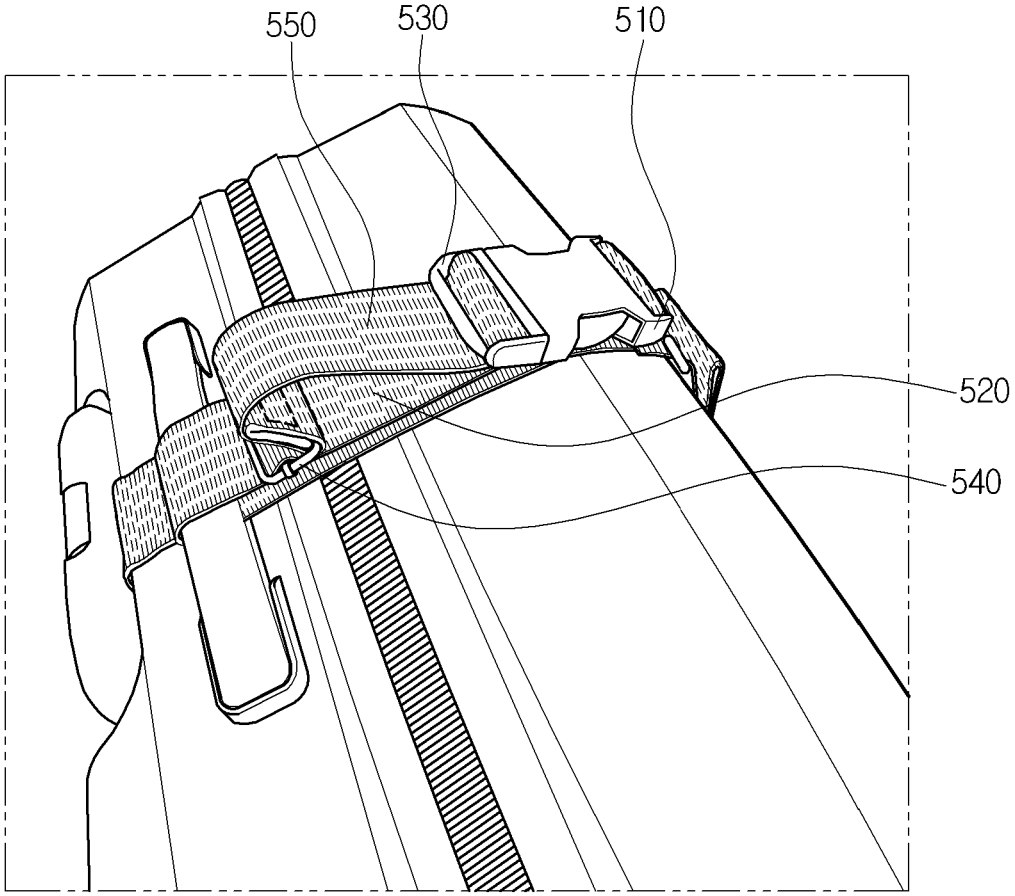
Figure 4F:
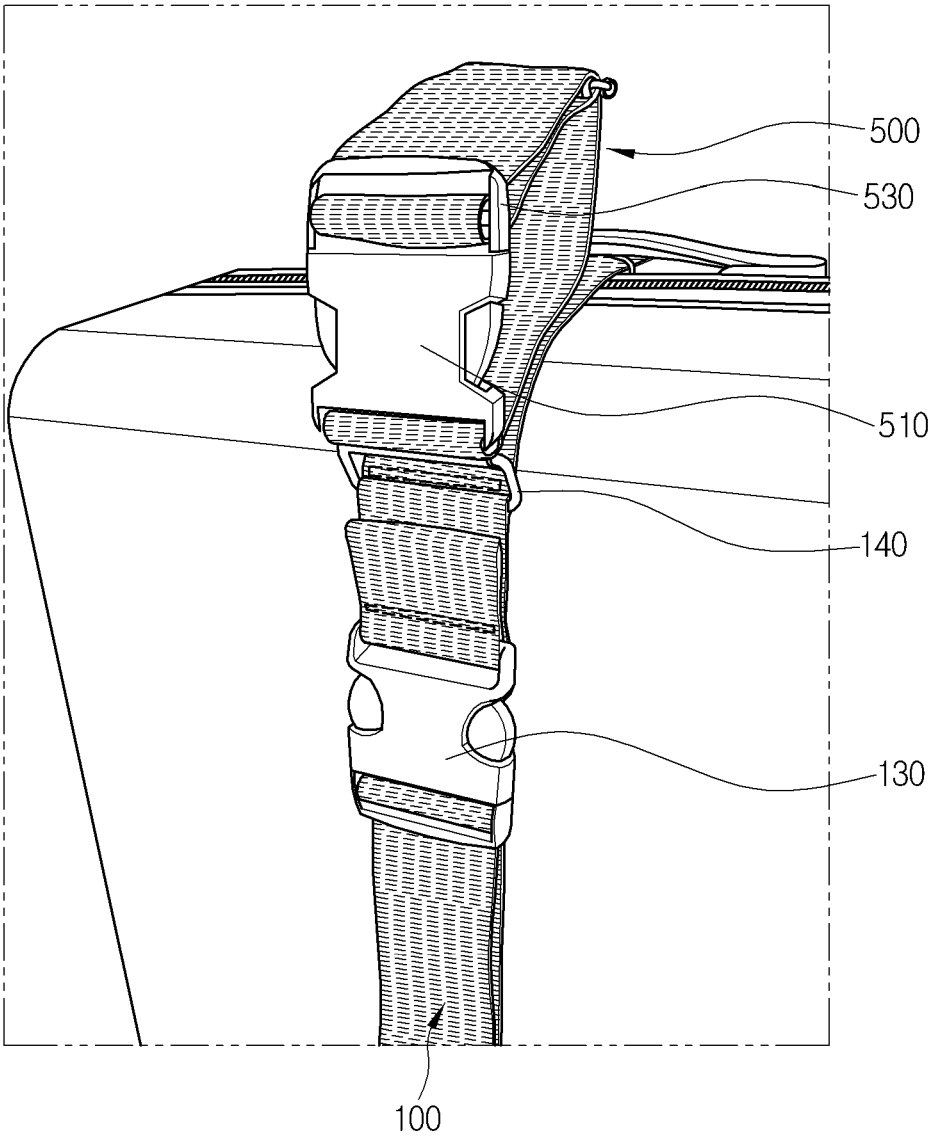

In addition, referring to FIG. 4E, a tightener 540 is provided at a middle position of the safety belt 520 to press the safety belt 520 and increase a support force for the load of the suitcase 10. A tension adjusting belt 550 is connected to an end of the safety belt. The tension adjusting belt 550 connects the male buckle 530 and the tightener 540, and passes through the male buckle 530 to neatly arrange an exposed portion of the belt. By pulling or releasing the tension adjusting belt 550, the length of the safety belt 520 may be adjusted. Thus, it is possible to further increase the support force for the load of the suitcase 10 by tightly adjusting the tension of the safety strap 500.

Figure 5A:
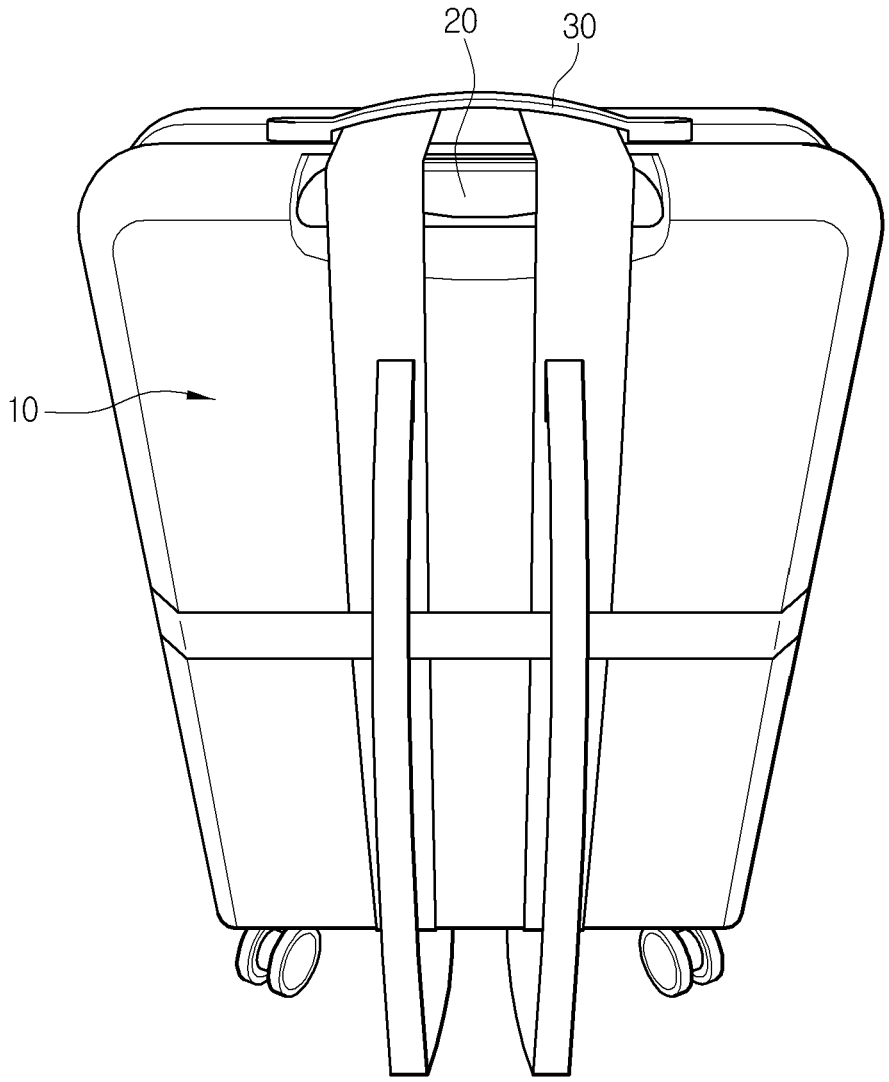
FIGS. 5A to 5C are views illustrating examples of equipment compared with equipment according to the present invention.
Figure 5B:
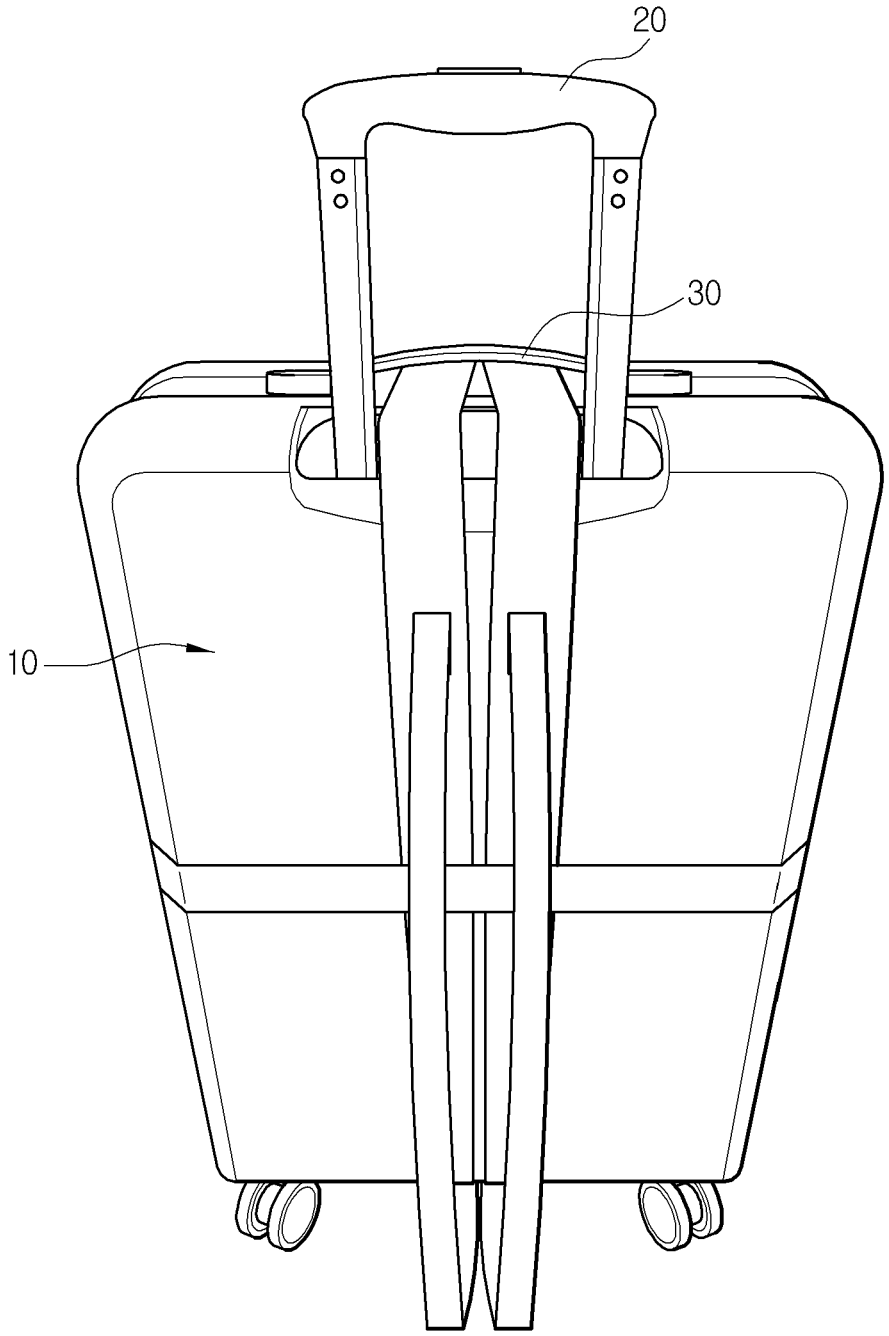
Figure 5C:
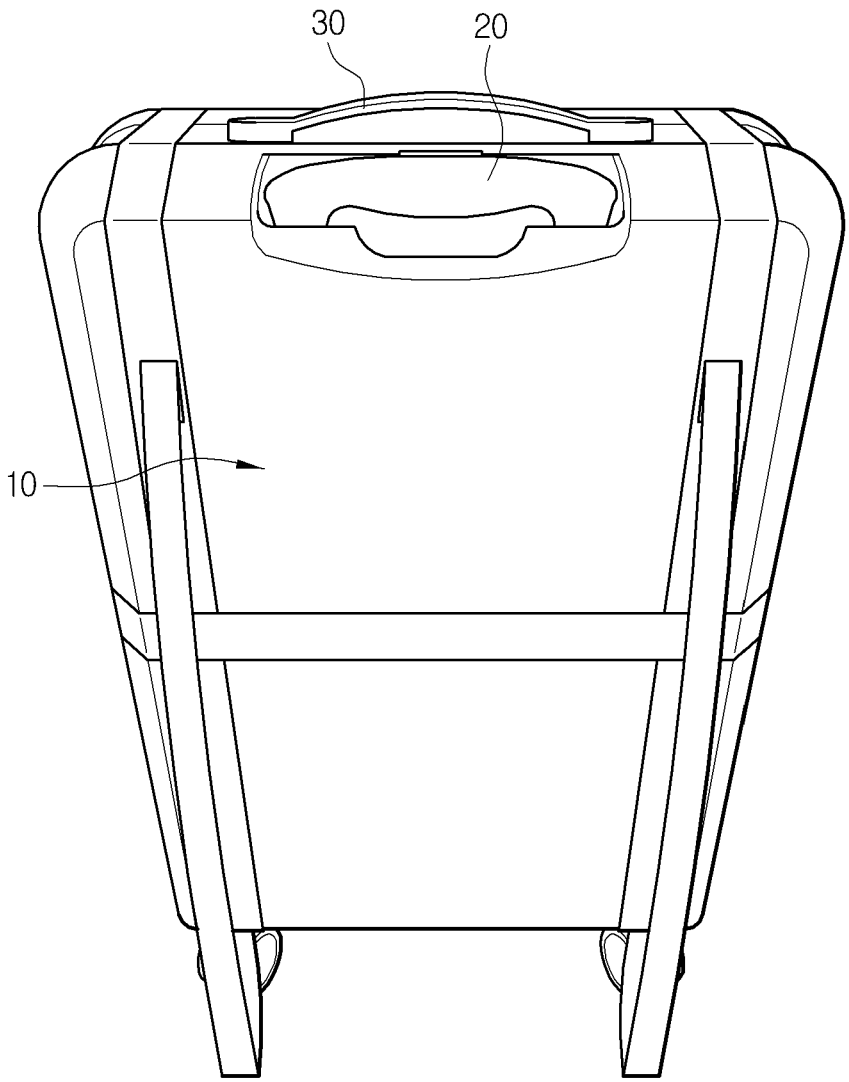

Meanwhile, FIGS. 5A to 5C illustrate comparative examples compared with the present invention. According to Comparative Example 1 of FIG. 5A, two longitudinal straps are attached to the central portion of the suitcase 10 side by side at a distance from each other, and one transverse strap is laterally attached to the central portion of the suitcase 10 to cross the longitudinal straps. Since the two longitudinal straps pass over the slidable handle 20, the longitudinal straps hinder the slidable handle 20 from being pulled out when a user desires to roll and carry the suitcase instead of being used as the backpack, so that it is necessary to remove the longitudinal straps, thus causing inconvenience to the user. Furthermore, when the suitcase is switched into the backpack, the rotational moment increases, so that the suitcase may shake or lean to one side, and pressure on the shoulders or the abdominal region may be increased.

According to Comparative Example 2 of FIG. 5B, two longitudinal straps are attached to the central portion of the suitcase 10 side by side in proximity to each other, and one transverse strap is laterally attached to the central portion of the suitcase 10 to cross the longitudinal straps. Since the two longitudinal straps pass through the inside of the slidable handle 20, the longitudinal straps do not hinder the slidable handle 20 from being pulled out. However, when the suitcase is switched into the backpack, the rotational moment increases, so that the suitcase may shake or lean to one side, and pressure on the shoulders or the abdominal region may be increased.

According to Comparative Example 3 of FIG. 5C, two longitudinal straps are attached to both sides of the suitcase 10 side by side while being spaced apart from each other at a considerable distance, and one transverse strap is laterally attached to the central portion of the suitcase 10 to cross the longitudinal straps. Since the two longitudinal straps pass through opposite sides of the slidable handle 20, it is possible to roll and carry the suitcase without removing the straps and to solve the problem of the rotational moment. However, after carrying the suitcase over the shoulders, the longitudinal straps may be dislodged or the longitudinal straps may continuously interfere with the slidable handle 20 or the wheels 40, so that the straps may be damaged and a user of a small build may not carry the shoulder straps over the shoulders. Furthermore, when one shoulder is put into one longitudinal strap and the other shoulder is put into the other longitudinal strap so as to carry the suitcase 10 over the shoulders, the suitcase is tilted at an angle. While a user wears the shoulder straps, the straps may be dislodged and consequently the suitcase may drop onto the ground.

By contrast, the equipment of the present invention makes it convenient to pull out a slidable handle 20 without the necessity of removing a strap, reduces a rotational moment, thus preventing the suitcase 10 from shaking or leaning to one side when the suitcase is carried over the shoulders, prevents the strap from being dislodged while the suitcase is carried over the shoulders, allows the suitcase to be easily carried over the shoulders, and reduces pressure on the shoulders or the abdominal region when the suitcase is carried over the shoulders.

While the invention has been shown and described with reference to exemplary embodiments thereof, it will be understood by those skilled in the art that various changes in form and details may be made therein without departing from the spirit and scope of the invention as defined by the appended claims. Therefore, it is to be understood that the scope of the invention is not limited to the above-described embodiments, and all changes that fall within meets and bounds of the claims, or equivalence of such meets and bounds are intended to be embraced by the claims.

What is claimed is:

1. Equipment for switching a suitcase into a backpack, comprising:

a longitudinal strap configured to be wrapped around a longitudinal circumference of a central portion on an exterior of the suitcase;

a transverse strap configured to be wrapped around a transverse circumference of a lower portion on the exterior of the suitcase to cross the longitudinal strap at a front surface and a rear surface of the suitcase;

a pair of shoulder straps detachably connected to the longitudinal strap and the transverse strap to allow the suitcase to be carried over a user's both shoulders, an upper portion of each shoulder strap being connected to an upper portion of the longitudinal strap, and a lower portion of the shoulder strap being connected to both sides of the transverse strap; and a safety strap configured for connecting a fixed handle provided on an upper portion of the suitcase with the upper portion of the longitudinal strap, thus preventing the longitudinal strap from being slipped when carrying the suitcase over the shoulders and allowing safe transport, wherein the safety strap comprises:

a female buckle connected to a rectangular ring that is provided on the upper portion of the longitudinal strap;

a safety belt connecting the rectangular ring and a male buckle, and passing through the fixed handle provided on the upper portion of the suitcase to be connected to a middle position thereof;

a male buckle connected with the safety belt to be fastened to the female buckle;

a tightener provided at the middle position of the safety belt to tighten the safety belt; and a tension adjusting belt connected between the male buckle and the tightener while being connected with the safety belt, to adjust a length of the safety belt and consequently adjust tension of the safety strap.

2. The equipment of claim 1, further comprising:

a pair of support straps connected to the longitudinal strap and the transverse strap in a "V" shape, each of the support straps being connected at one end thereof to the longitudinal strap attached to the lower surface of the suitcase and being connected at the other end to both sides of the transverse strap to support the transverse strap when the user carries the suitcase over his or her shoulders.

3. The equipment of claim 1, wherein the longitudinal strap and the transverse strap, attached to the rear surface that is opposite to the front surface of the suitcase coming into contact with the user's back when the suitcase is switched into the backpack and carried over the shoulders, comprise a longitudinal connection buckle and a transverse connection buckle, respectively, to facilitate attachment and detachment.

* * * * *